US005139215A

United States Patent [19]

Peckham

[11] Patent Number: 5,139,215

[45] Date of Patent: Aug. 18, 1992

[54] GUIDED MISSILES

[75] Inventor: Derek H. Peckham, Farnham, United Kingdom

[73] Assignee: The Secretary of State for Defence in Her Britannic Majesty's Government of the United Kingdom of Great Britain and Northern Ireland, London, England

[21] Appl. No.: 559,038

[22] Filed: Nov. 28, 1983

[30] Foreign Application Priority Data

Nov. 26, 1982 [GB] United Kingdom ..... 8233864

[51] Int. Cl.[5] ..... F41G 7/00; F42B 15/01

[52] U.S. Cl. ..... 244/3.21; 244/3.1; 244/3.24; 244/45 A; 244/47; 244/206

[58] Field of Search ..... 244/3.1, 3.21, 3.24-3.29, 244/45 A, 47, 199, 206

[56] References Cited

U.S. PATENT DOCUMENTS

| | | | |
|---|---|---|---|
| 3,195,462 | 7/1965 | Petre | 244/3.21 X |
| 3,196,794 | 7/1965 | Meade | 244/3.21 X |
| 3,262,655 | 7/1966 | Gillespie, Jr. | 244/3.1 X |
| 4,198,016 | 4/1980 | Wilson | 244/3.21 |
| 4,351,503 | 9/1982 | Drori | 244/3.24 |
| 4,373,688 | 2/1983 | Topleffe | 244/3.24 |

FOREIGN PATENT DOCUMENTS

| | | |
|---|---|---|
| 808032 | 1/1959 | United Kingdom . |
| 1517053 | 5/1978 | United Kingdom . |
| 2076109A | 1/1981 | United Kingdom . |

*Primary Examiner*—Harold J. Tudor
*Attorney, Agent, or Firm*—Cushman, Darby & Cushman

[57] ABSTRACT

A fuselage, particularly of a guided missile, having a rotatable nose body carrying a pair of similar strakes symmetricaly disposed about the body and for anchoring incidence generated vortices thereon.

10 Claims, 4 Drawing Sheets

Variation of side force with roll; α=36°

GUIDED MISSILES

BACKGROUND OF THE INVENTION

The present invention relates to guided missiles.

During flight at all but the lowest angles of incidence the air flow separates over the leeward side of slender bodies to form vortices. This vortex flow can be symmetric, but is more usually asymmetric with the result that a side force (and yawing moment) is generated in addition to the normal force on the body in the pitch plane. This 'out-of-plane' force is undesirable in guided missiles in that it complicates the control of maneuvering.

Various means have been sought to reduce, or eliminate, this out-of-plane force but with limited success. One class of solution is to modify the nose region, for example by providing strakes to anchor the vortices and their development. A pair of such strakes has been successful, but only in respect of one roll orientation of the body, i.e. the strakes have to be substantially symmetrical about the pitch plane. The use of a plurality of bodies or strakes, rings or transition bands, all around the nose area, was discussed in the 1972 AIAA Paper 72/968 "Occurrence and inhibition of large yawing moments during high incidence flight of slender missile configurations" by William H Clark et al. They too are not entirely successful and anyway have undesirable drag penalties.

Another class of solution is to 'average-out' the asymmetries, e.g. by a continuously-rotating nose section; this approach, which is described in NEAR Inc's Technical Report 212 of December 1979, "Active Control of Asymmetric Vortex Effects" by John E Fidler, has the merit of applying at all roll orientations but has been found not fundamentally to reduce the magnitude of the out-of-plane forces.

SUMMARY OF THE INVENTION

The present invention provides means on a fuselage such as that of a guided missile which will both reduce the magnitude of out-of-plane forces and apply at all roll orientations without significant drag or other penalty.

According to the present invention a fuselage has at the nose thereof a pair of similar strakes in laterally symmetrical array and arranged for rotation about a fuselage longitudinal axis for controlling vortex flow about the fuselage when it is flying at incidence.

The fuselage may have a freely rotatable nose body carrying the strakes, which preferably commence at the nose body tip. The nose body may be a cone, particularly one which is ogival in planform. The nose body is preferably made as light as possible, and may for that purpose be made of a fibre, e.g. carbon fibre, reinforced plastics material, etc. The strakes need extend rearwards by no more than about one fuselage diameter and their span may be between 5-50% of the local fuselage diameter. The strakes may effectively be set at a dihedral angle, that is the tips thereof may have a dihedral angle of 5°-40° while the effective plane of each strake may lie in a fuselage radial plane or be offset therefrom.

The strakes are preferably sharp edged and may be simply planar. Typically their planform is that of a straight edged delta or an ogive.

As an alternative to allowing the nose body to rotate freely, control means may be provided. Such control means may comprise an attitude sensor and a motor arranged for rotating the body to a desired configuration. The provision of such control means affords the additional advantage of enabling the provision of an input command means whereby a nose body can be set to such an angle that side force can actually be generated and used to control the attitude and direction of the fuselage.

Particularly for long slender fuselages, a repeater unit may be provided further back along the fuselage, the repeater unit comprising a pair of similar repeater strakes laterally symmetrically disposed and rotatable on the fuselage about the fuselage longitudinal axis. The ring may be freely rotatable or provided with attitude control means as above described with respect to the nose body. The strakes may have an effecting dihedral angle and be simply planar and of a planform as described above in respect of the nose strakes.

The invention is particularly suitable for application to those guided missile fuselages which are required in high manoeuvrability subsonic contexts. It may however be of value at supersonic speeds and even afford considerable advantage on certain aircraft fuselages.

BRIEF DESCRIPTION OF THE DRAWINGS

Embodiments of the invention will now be described by way of example with reference to the accompanying drawings, of which.

DETAILED DESCRIPTION OF THE PREFERRED EMBODIMENTS

Figure 1:
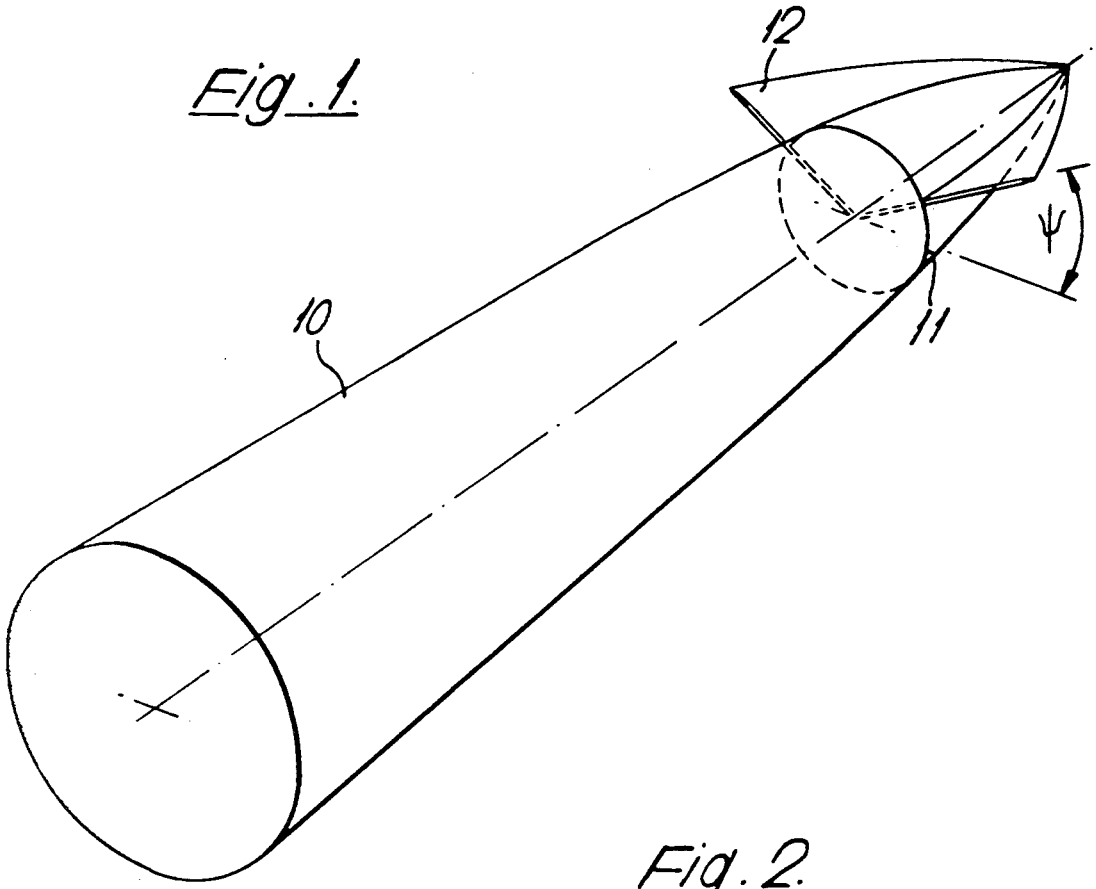
FIG. 1 is a perspective view of a forward part of a guided missile.
Figure 2:
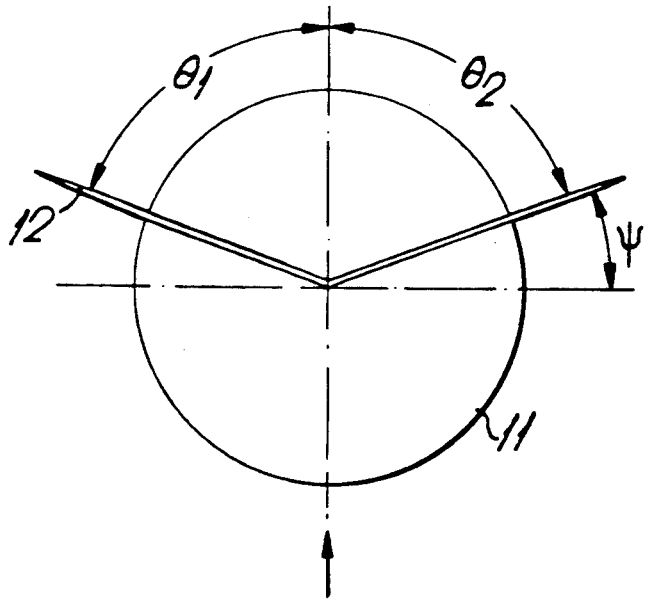
FIG. 2 is a front elevation of the missile illustrated in FIG. 1.

The guided missile shown in FIGS. 1 and 2 has a fuselage 10 carrying thereon and freely rotatable about the longitudinal axis thereof a nose cone 11. The nose cone carries a pair of similar sharp-edged strakes 12, originating at the leading point thereof and set in dihedral array with a dihedral angle $\Psi$.

In the flight of such a missile, the nose cone 11 weathercocks so that the strakes 12 are symmetrical about the instantaneous air speed cross flow component, i.e. $\theta_1=\theta_2$, whereby, similar and symmetrically disposed vortices are generated by the strakes.

In a particular example of the invention, the nose cone 11 has a length of 100% the missile maximum diameter and carries strakes 12 having a span of 30% of the local missile diameter and a dihedral angle $\Psi=20°$.

Figure 3:
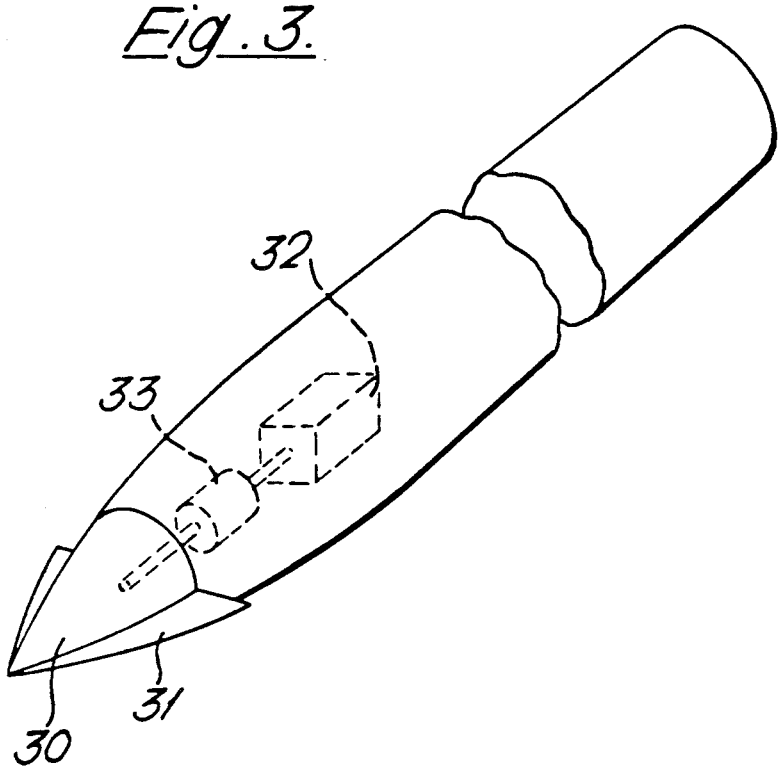
FIG. 3 is a schematic diagram of a missile nose cone with control means.

The missile fuselage illustrated in FIG. 3 has a nose cone 30 carrying strakes 31 similar to the arrangement described with reference to FIGS. 1 and 2 except that the nose cone 30 is not freely rotatable about the fuselage. A control unit comprising an altitude sensor and command unit 32 and a motor 33 is drivably associated with the cone 30.

The control unit is typically arranged to come into play when the angle of incidence of the fuselage is greater than the included angle of the nose cone, i.e. when vortex flow fields are generated, and has two modes of operation. One is to rotate the nose cone 30 to such a configuration ($\theta_1=\theta_2$) that any unwanted side force and yawing moment generated by a vortex field unbalance is counteracted and attenuated. The other is to set the nose cone 30 to such a configuration ($\theta_1\neq\theta_2$) that a vortex unbalance and hence a side force and yawing moment are generated.

Figure 4:
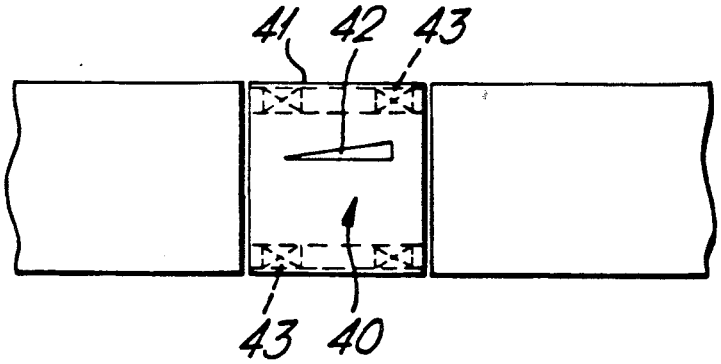
FIG. 4 is a schematic section of a missile fuselage with a repeater unit.

The section of a missile fuselage illustrated in FIG. 4 is toward the rear of a particularly slender body and incorporates a vortex control repeater unit 40. This comprises a sleeve 41 carrying strakes 42 and rotatable on bearings 43 around the fuselage. The strakes 42 are a symmetrical pair and mounted at a dihedral angle to the fuselage.

In missile operation at such an angle of incidence that vortices are generated around the fuselage, the repeater unit 40 rotates to a symmetrical configuration with respect to the air speed cross-flow component and anchors the vortices therearound, keeping them symmetrical.

Figure 5:
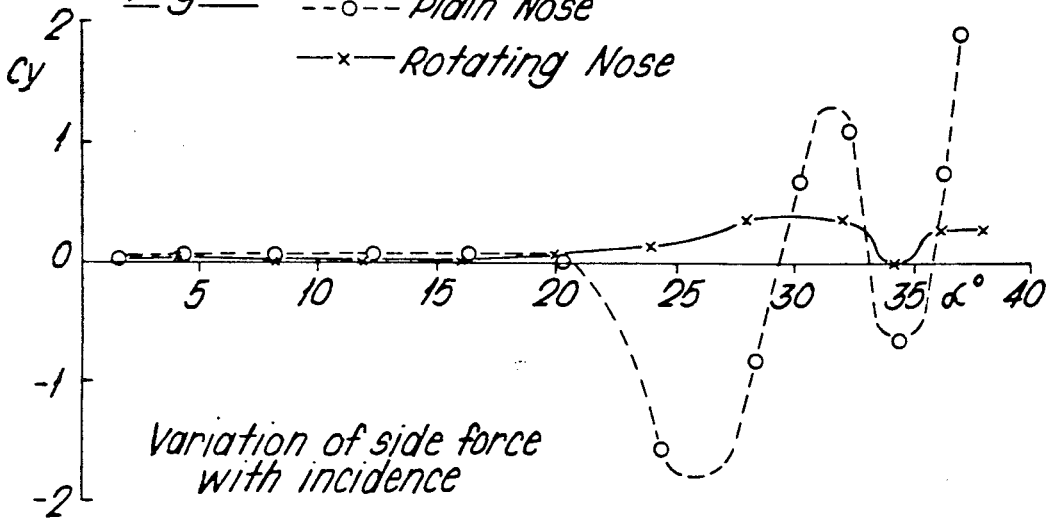
FIG. 5 is a graph of the variation of side force with incidence.
Figure 7:
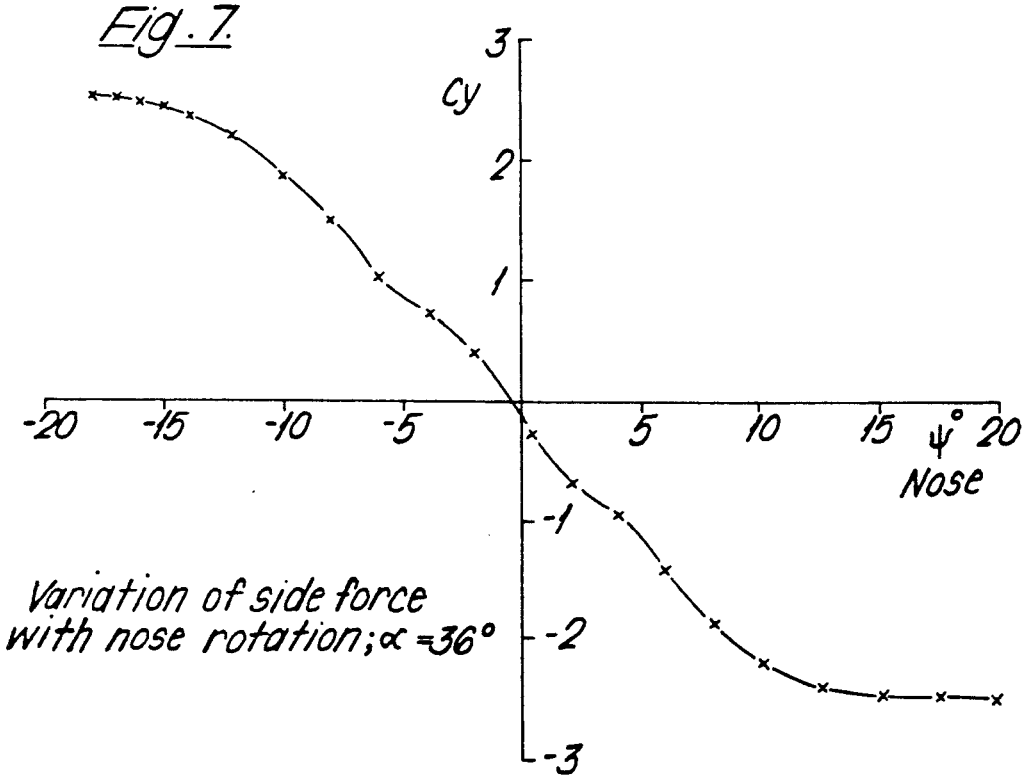
FIG. 7 is a graph of the variation of side force with nose rotation at a given incidence.
Figure 6:
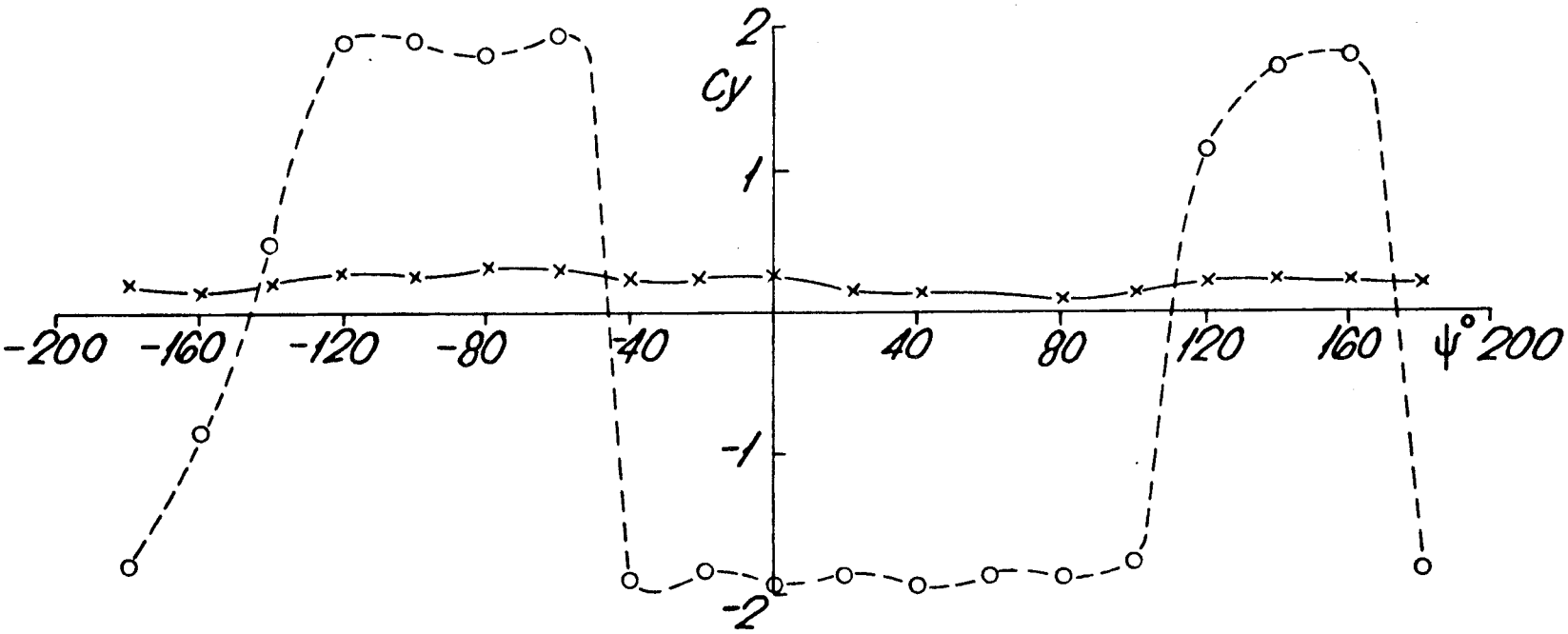
FIG. 6 is a graph of the variation of side force with roll at a given incidence.

FIGS. 5, 6 and 7 relate to wind-tunnel tests on a cone-cylinder model having a 10 deg semi-apex angle conical nose faired by a circular-arc profile to the body diameter. The nose length was 3.33 calibres and the overall length of the model was 7.625 calibres. The tests were made at a Mach number of 0.3 and atmospheric pressure, giving a Reynolds number based on the model cylinder diameter (0.297 m) of $2\times10^6$. A portion of the body nose 1.04 calibres long was free to rotate on a shaft and the nose was fitted with a strake of total apex angle 40 deg (in plan projection), with a root chord of 0.81 calibres and a dihedral angle on each side of 20 deg.

During the tests it was found that the nose portion of the model weathercocked to an attitude symmetric about the cross-flow plane, whatever the roll orientation of the body, as intended.

FIG. 5 compares the side force obtained on the body without strakes. On the body with strakes, the angle of incidence at which side force begins to develop is increased, and the magnitude of the side force subsequently developed is reduced, for the range of incidence covered of up to 38 deg.

FIG. 6 shows the variation of side force with roll angle for an angle of incidence of 36 deg. On the body without strakes there were rapid reversals in the sign of the side force as the body was rolled, whereas on the body with strakes side force remained at a low and nearly uniform level.

FIG. 7 shows the potential as a control device of a straked nose which can be driven to a desired roll angle relative to the parent body. For the body at an angle of incidence of 36 deg (and held at a fixed roll attitude), controlling the nose portion over a roll angle of ±20 deg relative to the body, gives a smooth variation of side force from a positive level one side to a negative level on the other side.

In another embodiment of the invention, the strakes are supplemented by a fin of larger span and area than each strake and are arranged for deployment in anhedral array, that is on the opposite side of the strake carrier—be it ring or nose body etc—to the fin.

I claim:

1. Apparatus for reducing out-of-plane forces in an airframe having a fuselage with a longitudinal axis, comprising:

a nose body coupled to said fuselage and rotatable about said longitudinal axis; and aerodynamic surfaces consisting of first and second strakes coupled to said nose body and forming an angle of from substantially 100° to substantially 170° with respect to each other, said strakes generating two similar and symmetrical vortices when said airframe is in flight.

2. Apparatus according to claim 1 wherein a portion of each of said first and second strakes is coupled to a tip of said nose body.

3. Apparatus according to claim 1 wherein said fuselage has a caliber, and wherein said first and second strakes each extend a distance up to one fuselage caliber along a direction parallel to said longitudinal axis.

4. Apparatus according to claim 1 wherein said first and second strakes form an angle of substantially 140° with respect to each other.

5. Apparatus according to claim 1 wherein each of said first and second strakes have sharp edges.

6. Apparatus according to claim 1 wherein said nose body is freely rotatable about said fuselage.

7. Apparatus according to claim 1 further including control means for controlling the rotation of said nose body with respect to said fuselage.

8. Apparatus according to claim 1 further including a repeater unit coupled to said fuselage at a predetermined distance from said nose body, said repeater unit comprising:

a totatable body coupled to said fuselage and rotatable about said longitudinal axis;

repeater aerodynamic surfaces consisting of third and fourth strakes coupled to said rotatable body and forming an angle of from substantially 100° to substantially 170° with respect to each other, said third and fourth strakes generating similar and symmetrical vortices when said airframe is in flight.

9. Apparatus according to claim 8 wherein said rotatable body is freely rotatable about said fuselage longitudinal axis.

10. Apparatus according to claim 8 further including repeater control means for controlling the rotation of said rotatable body about said fuselage longitudinal axis.

* * * * *